United States Patent [19]

Friese et al.

[11] Patent Number: 4,939,409

[45] Date of Patent: Jul. 3, 1990

[54] SPARK PLUG WITH A SURFACE DISCHARGE SECTION

[75] Inventors: Karl-Hermann Friese, Leonberg; Werner Grünwald, Gerlingen; Kurt Schmid, Ditzingen-Schöckingen, all of Fed. Rep. of Germany

[73] Assignee: Robert Bosch GmbH, Stuttgart, Fed. Rep. of Germany

[21] Appl. No.: 290,168

[22] PCT Filed: May 23, 1987

[86] PCT No.: PCT/DE87/00235

§ 371 Date: Dec. 7, 1988

§ 102(e) Date: Dec. 7, 1988

[87] PCT Pub. No.: WO87/07778

PCT Pub. Date: Dec. 17, 1987

[30] Foreign Application Priority Data

Jun. 12, 1986 [DE] Fed. Rep. of Germany ..... 3619854

[51] Int. Cl.[5] ..... H01T 13/20; H01T 13/52

[52] U.S. Cl. ..... 313/130; 313/136; 313/141

[58] Field of Search ..... 313/130, 131 A, 141, 313/136, 137, 142, 131

[56] References Cited

U.S. PATENT DOCUMENTS 4,406,968 9/1983 Friese et al. ..... 313/141 X 4,414,483 11/1983 Nishio et al. ..... 313/136

*Primary Examiner*—Palmer C. DeMeo

*Attorney, Agent, or Firm*—Michael J. Striker

[57] ABSTRACT

A spark plug with a surface discharge section for internal combustion engines comprising an insulation body having an inner cavity for receiving a mass of an electrically conductive material, and a bore extending from the inner cavity and through which extends a central electrode which is formed integral with the surface discharge surface, is made of an electrically non-conductive material, and has on an outer surface thereof in the area of the mass and the bore an electrically conductive film, and, in the area defining the surface discharge section a film having no intrinsic conductivity after sintering.

5 Claims, 1 Drawing Sheet

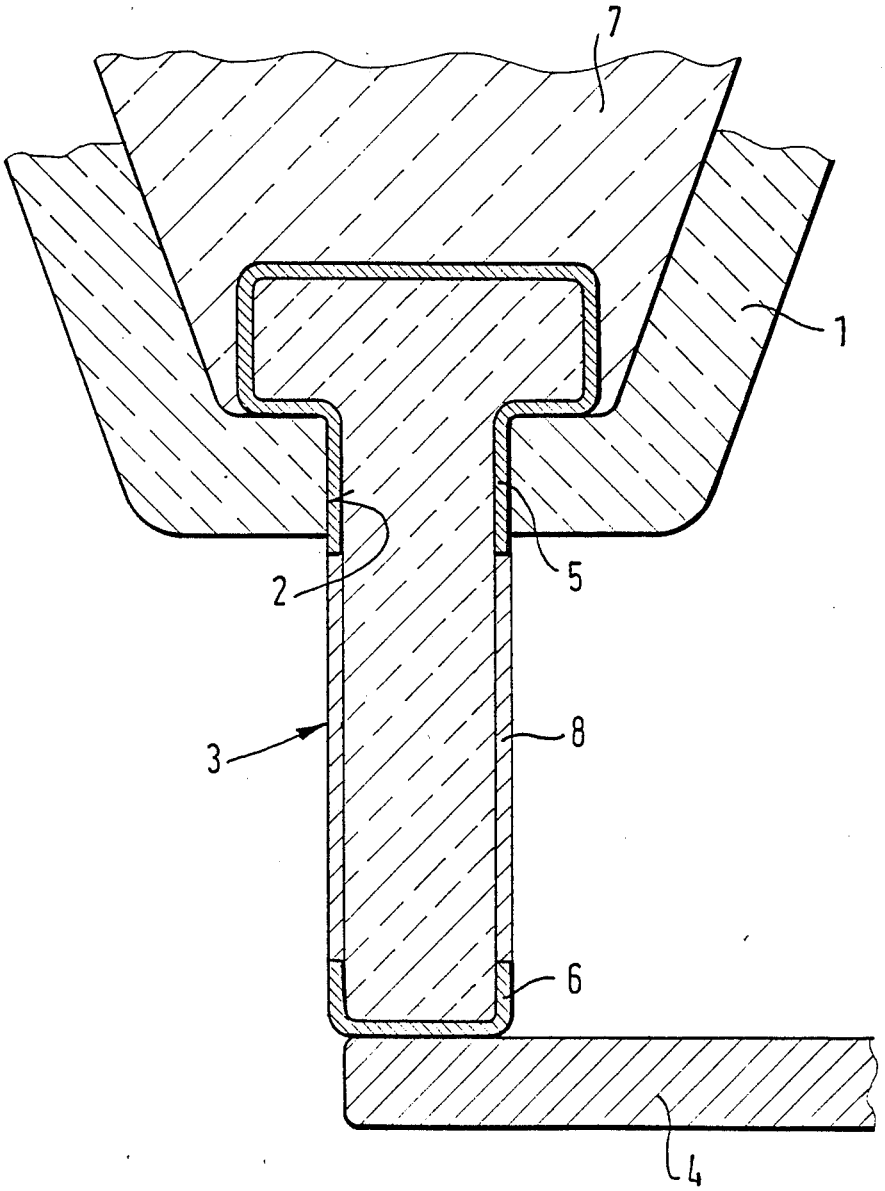
7
1
2
5
3
8
6
4

SPARK PLUG WITH A SURFACE DISCHARGE SECTION

BACKGROUND OF THE INVENTION

The invention relates to a spark plug having a surface discharge gap. A spark plug with a surface discharge section for internal combustion engines is known, e.g. from the DE-OS 35 33 123, in which the insulation body is divided transversely and comprises an upper part on a connection side made of a material with a relatively low dielectric constant, and a lower part on a combustion chamber side made a material with a much higher dielectric constant. Such spark plugs are unobjectionable with respect to operation, but are relatively complicated to produce because of the divided insulator body.

SUMMARY OF THE INVENTION

In the spark plug according to the invention, the center electrode and the surface discharge section are made of an electrically non-conductive material and have electrically conductive films thereon has the advantage that it is simple to produce by means of thick-film technique, and the surface discharge films are highly effective and stable over a long period of time.

It is particularly advantageous that the electrically non-conductive ceramic consist of $Al_2O_3$, and the electrically conductive film on the ceramic part consist of platinum or a platinum-$Al_2O_3$ mixture with 60 to 85 percent by weight of platinum. The film of the surface discharge gap is produced from a platinum-$Al_2O_3$ mixture with 10 to 40 percent by weight of platinum.

BRIEF DESCRIPTION OF THE DRAWINGS

The invention both as to its construction and its method of operation, together with additional and advantages thereof, will be best understood from the following description with reference to an accompanying single FIGURE which shows schematically a partial cross-section of a spark plug according to the present invention.

DESCRIPTION OF THE PREFERRED EMBODIMENT

The spark plug shown in the drawing, comprises a spark plug insulation body 1 made of aluminum oxide and comprising a bore 2 on a combustion chamber side. A T-shaped structural component part which is made e.g., of aluminum oxide and carries various surface coatings is located in the bore 2. The counter-electrode is indicated by a numeral 4. The structural component part 3 has a coating 5 within the spark plug body 1 and within the bore 2. The coating 5 projects a little beyond an end surface of the body 1. The coating 5 is electrically conductive and consists either of platinum or of a platinum-$Al_2O_3$ mixture with 60 to 85 percent by weight of platinum and has a thickness of 5 to 15 $\mu$m. The coating 6 on the structural component part 3 in the vicinity of the counter-electrode 4 consists of the same material, the coating 6 forming an electrical contact with the counter-electrode 4. The contact of the electrically conductive coating 5 within the spark plug insulation body 1 is effected with an electrically conductive glass 7 in the form of a molten glass mass located in an inner cavity of the spark plug insulation body, as known, e.g., from the US-PS 3 909 459.

The spark discharge film 8 between the coatings 5 and 6 consists of a platinum-$Al_2O_3$ mixture with 10 to 40 percent by weight of platinum. After sintering the discharge film 8 has no intrinsic conductivity, since only individual islands of conductivity are formed which do not contact one another electrically, but provide for high displacement currents, which corresponds to a high dielectric constant. This coating 8 likewise has a thickness of 5 to 15 $\mu$m.

In order to produce this spark plug, a T-shaped structural component part 3 made of aluminum oxide, is first produced and annealed at 1100° to 1150° C., but not yet sintered. The electrically conductive coatings 5 and 6 are then applied to this structural component part 3 by immersion or printing, and the surface discharge film 8 is then applied to it by printing or brushing on. The structural component part 3 with the coatings 5, 6 and 8 is then inserted into the bore 2 of the spark plug 1, which is also only annealed. The bore 2 has a diameter which just fits the structural component part 3. The entirety is then sintered in the usual manner at temperatures between 1500° and 1600° C., whereby a secure engagement is formed between the structural component part 3 and the spark plug body 1, and the surface discharge film 8 obtains the aforementioned characteristics. The cavity of the spark plug body 1 is then filled with the electrically conductive glass 7 in the form of a molten glass mass. The upper part of a center electrode with a connection, which upper part is not shown in the drawing, is inserted into the cavity, whereupon the assembly is sealed at a sealing temperature suitable for the respective type of glass, which can lie in the range between 800° and 900° C. After cooling, the assembly together with the counter-electrode 4 is sintered in a gastight manner in the spark plug housing in such a way that the electrically conductive coating 6 and the counter-electrode 4 contact one another.

Practical tests have shown that such spark plugs have a very favorable service life and the surface discharge films are highly effective and stable over a long period of time.

While the preferred embodiment of a spark plug with a surface discharge gap has been illustrated and described, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A spark plug for internal combustion engines comprising an insulation body having an inner cavity and a bore extending from said cavity; a mass of an electrically conductive material located in said inner cavity; a central electrode extending through said bore and contacting said mass; a counter-electrode facing said bore; and a surface discharge section extending between said central electrode and said counter-electrode, said central electrode and said surface discharge section being formed as a single part made of an electrically non-conductive ceramic material and having an outer surface which is covered in the area of said mass and said bore with a first electrically conductive film and in the area defining said surface discharge section, with a second film which after sintering has no intrinsic conductivity but provides for a high displacement current.

2. A spark plug according to claim 1 wherein said electrically non-conductive ceramic material is composed of $Al_2O_3$.

3. A spark plug according to claim 1 wherein said first film is composed of a platinum-$Al_2O_3$ mixture including 60–85 percent by weight of platinum.

4. A spark plug according to claim 1 wherein said second film is composed of a platinum-$Al_2O_3$ mixture including 10–40 percent by weight of platinum.

5. A spark plug according to claim 1 wherein said central electrode is located at an end surface of said insulation body facing the combustion chamber of the internal combustion engine.

* * * * *